United States Patent [19]

Shimotsuma

[11] 4,217,540

[45] Aug. 12, 1980

[54] VOLTAGE REGULATED ELECTRONIC TIMEPIECE

[75] Inventor: Nobuo Shimotsuma, Tokyo, Japan

[73] Assignee: Kabushiki Kaisha Daini Seikosha, Tokyo, Japan

[21] Appl. No.: 918,594

[22] Filed: Jun. 23, 1978

[30] Foreign Application Priority Data

Jun. 27, 1977 [JP] Japan ..... 52-76807

[51] Int. Cl.[2] ..... G05F 3/08

[52] U.S. Cl. ..... 323/22 R; 368/218

[58] Field of Search ..... 58/23 A, 23 BA; 307/296 R, 297; 323/1, 4, 22 R

[56] References Cited

U.S. PATENT DOCUMENTS

| | | | |
|---|---|---|---|
| 3,813,595 | 5/1974 | Sheng | 323/22 R |
| 3,832,644 | 8/1974 | Nagata et al. | 323/22 R |
| 3,975,649 | 8/1976 | Kawagoe et al. | 323/22 R |
| 4,135,125 | 1/1979 | Oura | 323/22 R |

*Primary Examiner*—A. D. Pellinen

*Attorney, Agent, or Firm*—Robert E. Burns; Emmanuel J. Lobato; Bruce L. Adams

[57] ABSTRACT

A voltage regulating circuit for supplying a regulated voltage to an electronic circuit of an electronic timepiece. The voltage regulating circuit is comprised of an N-MOS and a P-MOS transistor pair connected in series with drains and gates connected together at a common junction, and a constant current source for providing a constant current through the transistor pair for developing the regulated voltage thereacross. The constant current source is comprised of a third MOS transistor connected in series with the transistor pair, and a biasing circuit for biasing the third MOS transistor to provide a constant current through the transistor pair. The voltage regulating circuit and the electronic circuit of the electronic timepiece are both integrated circuits formed on a common integrated circuit chip.

4 Claims, 4 Drawing Figures

VOLTAGE REGULATED ELECTRONIC TIMEPIECE

BACKGROUND OF THE INVENTION

The present invention relates to an electronic watch having a voltage-regulating circuit.

DESCRIPTION OF THE PREFERRED EMBODIMENT

Figure 1:
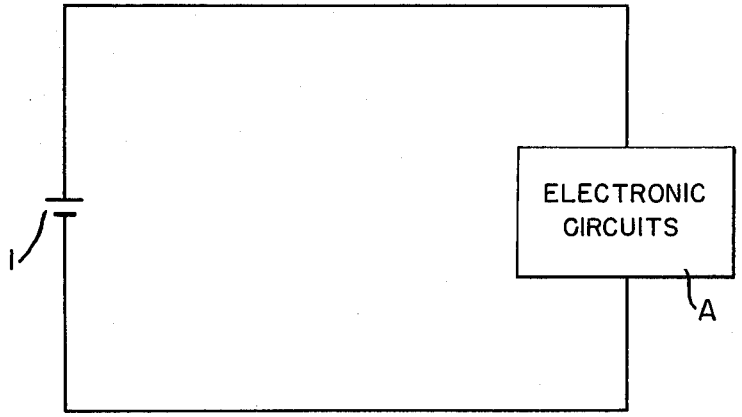
FIG. 1 PRIOR ART
FIG. 1 is a block diagram of the conventional electronic watch.

The conventional electronic watch consists of a battery 1 and an electronic circuit A, as shown in FIG. 1. However, ICs consisting of CMOS transistors have been utilized in the circuit A without any improvement of the circuit for extending the lifetime of the battery 1 in the electronic watch. The object of the present invention is to provide a circuit which will extend the lifetime of the battery 1.

Figure 2:
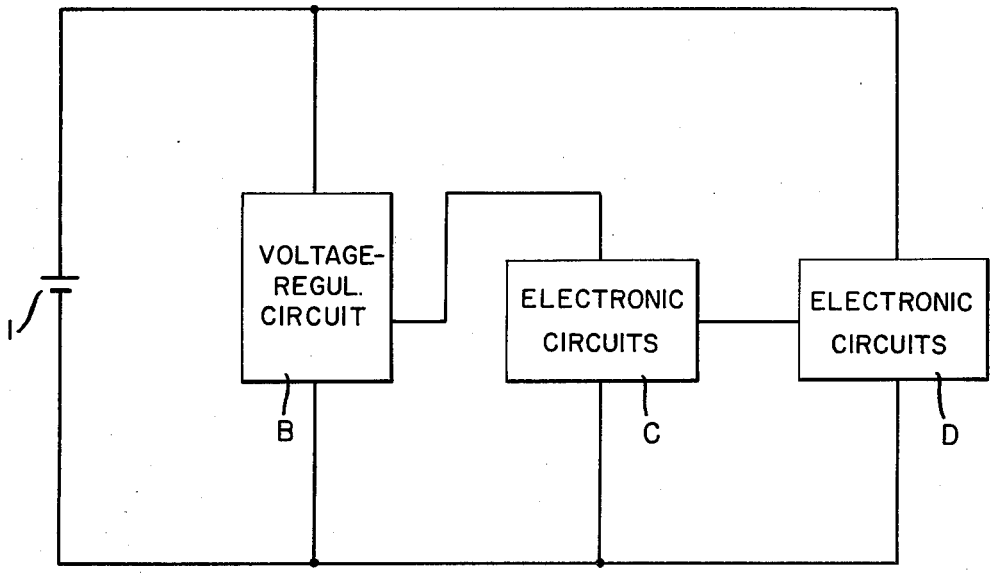
FIG. 2 is a block diagram of an electronic watch according to the present invention.
Figure 3:
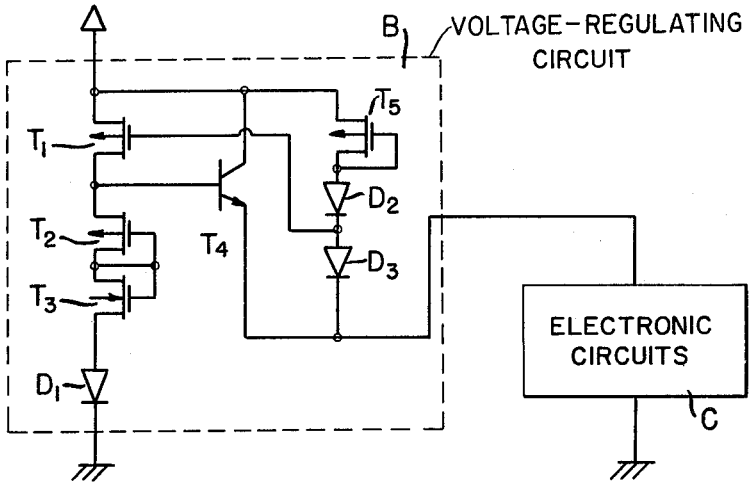
FIG. 3 is a circuit diagram of a embodiment of the voltage-regulating circuit according to the present invention; and, FIG. 4 is a circuit diagram of another embodiment of the voltage-regulating circuit according to the present invention.
Figure 4:
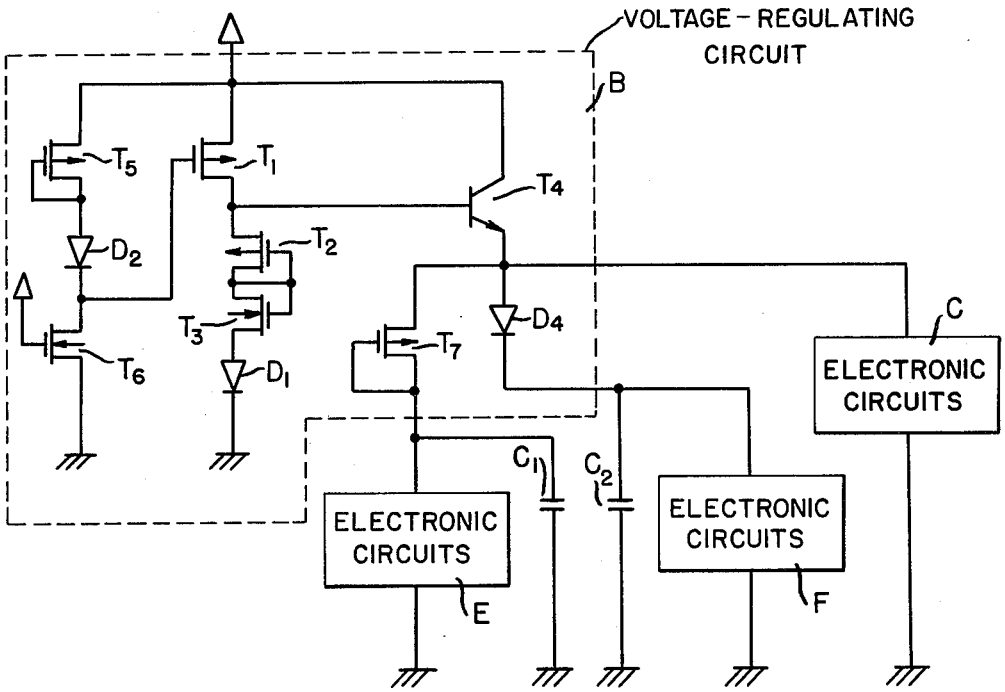

The construction of the device according to the present invention will be described in conjunction with the drawings; FIGS. 2–4. FIG. 2 shows a block diagram of an electronic watch. B is a voltage regulating circuit, C is an electronic circuit and, D is an electronic circuit. The battery 1 is connected to the voltage regulating circuit B and to the electronic circuit D in parallel, respectively. The voltage-regulating circuit B serves as a power source of the electronic circuit C. The output of the electronic circuit C is connected to the electronic circuit D.

The mode of operation will be described. A signal from the electronic circuit C which is operated by the application of the regulated output voltage from the voltage-regulating circuit B is sent to the electronic circuit D which does not require any regulated output voltage.

An electronic watch which consists of the electronic circuit C and the voltage-regulating circuit B, but which does not have the electronic circuit D is also included within the scope of the present invention.

Now, the embodiment of the voltage-regulating circuit B according to the present invention will be described in conjunction with FIG. 3. $T_1$ is a PMOS transistor, $T_2$ is a PMOS transistor, $T_3$ is a NMOS transistor, $D_1$ is a diode, $T_4$ is a NPN transistor, $T_5$ is a PMOS transistor, $D_2$ is a diode, and $D_3$ is a diode. The transistor $T_1$, the transistor $T_2$, the transistor $T_3$ and the diode $D_1$ are connected in series. The gate of the transistor $T_1$ is connected to the mode at which the diodes $D_2$ and $D_3$ are connected. Each drain of the transistors $T_2$ and $T_3$, and each gate of the transistors $T_2$ and $T_3$ are connected. The transistor $T_5$, the diode $D_2$ and the diode $D_3$ are connected in series. The gate of the transistor $T_5$ is connected to the drain of $T_5$. The collector of the transistor $T_4$, the source of the transistor $T_5$ and the source of the transistor $T_1$ are connected to the positive terminal of the battery 1, respectively. The base of the transistor $T_4$ is connected to the junction mode between the transistors $T_1$ and $T_2$. The emitter of the transistor $T_4$ is connected to the diode $D_3$, and is also connected to the electronic circuit C.

Due to the operation of the transistor $T_5$ and the diodes $D_2$ and $D_3$, the voltage which appears across the series combination of the transistor $T_5$ and the diode $D_2$ is applied to the transistor $T_1$, so the transistor $T_1$ can be operated as a constant current source (wherein the transistor is used in a saturation region). The constant current supplied from the transistor $T_1$ makes the series combination of the transistors $T_2$, $T_3$ and the diode $D_1$ operate as a regulating-voltage source. The standard voltage of the regulating-voltage source is supplied to the electronic circuit C through the transistor $T_4$.

The operation will be described in more detail. Assuming that the threshold voltage of the transistor $T_2$ is Vth2, the threshold voltage of the transistor $T_3$ is Vth3, the forward voltage of the diode $D_1$ is $V_d$, the base voltage of the transistor $T_4$ is $V_B$, the gate-source voltage of the transistor $T_1$ is $V_{GS}$, the source-drain voltage of the transistor $T_1$ is $V_{DS}$, the emitter voltage of the transistor $T_4$ is $V_E$ and, the voltage of the battery 1 is $V_{DD}$, the following equations should hold.

$$V_B = Vth2 + Vth3 + V_d \quad (1)$$

$$V_{DD} = V_B + V_{DS} \quad (2)$$

If the base-emitter voltage of the transistor $T_4$ represents by $V_{BE}$, $V_E$ is given by $$\begin{aligned} V_E &= V_B - V_{BE} \\ &= Vth2 + Vth3 + V_d - V_{BE} \end{aligned} \quad (3)$$

The equation (3) shows that if the electronic circuit C is fabricated by using a CMOS technique, it can be formed on the same IC chip together with the voltage-regulating circuit B. Generally, the various P channel MOS transistors in the same IC chip are the same in threshold-voltage level, and also, generally, the various N channel MOS transistors in the same IC chip are the same in threshold-voltage level.

Since it is understood that the base-emitter voltage $V_{BE}$ of the transistor $T_4$ which is formed from the same P-N junction is also equal to the forward voltage $V_d$ of the diode $D_1$, the following equation should hold.

$$V_d \div V_{BE} \quad (4)$$

Substituting into Eqn (3), $$V_E \div Vth2 + Vth3 \quad (5)$$

This $V_E$ supplies the operating voltage to an inverter consisting of the CMOS transistors in the electronic circuit C. Since, in practice, the above-mentioned threshold voltages Vth2 and Vth3 can be defined only when the current takes a certain value, if the current value varies the value of $V_B$ represented by Eqn. (1) will be varied. Assuming that the forward voltage of the diode $D_2$ is $V_{d2}$ and the drain-source voltage of the transistor 5 is $V_{DS5}$, the base of the transistor $T_5$ is connected to the drain thereof so that $V_{DS5}$ becomes the threshold voltage Vth5 which is determined in accordance with the value of the current flowing through the transistor $T_5$.

That is, $$V_{DS5} = Vth5 \quad (6)$$

$V_{GS}$ of the transistor $T_1$ is given by $$V_{GS} = Vth5 + V_{d2} \quad (7)$$

when the transistor $T_1$ is operated as a constant current transistor which does not depend on the voltage, i.e. the transistor may be operated within a saturation region. For this, it is generally required to satisfy the following equation. Assuming that the threshold voltage of the transistor $T_1$ is Vth1, the following relationship should hold.

$$Vth1 < V_{GS} < V_{DS} + Vth1 \quad (8)$$

As described above, since the transistors $T_1$ and $T_5$ are formed on the same chip, it can be considered that the threshold voltage of the transistor $T_5$ is equal to that of the transistor $T_1$.

Therefore, the following equation should hold.

$$Vth5 \div Vth1 \quad (9)$$

By inserting Eqns. (9) and (7) into Eqn. (8), $$Vth1 < Vth1 + V_{d2} < V_{DS} + Vth1 \quad (10)$$

is obtained. If the following equation $$V_{d2} < V_{DS} \quad (11)$$

is satisfied, the transistor $T_1$ will operate as the constant-current transistor. It is quite all right that a plurarity of diodes are used and are connected so as to satisfy Eqn. (11) instead of the diodes $D_2$ and $D_3$.

Moreover, the diodes $D_2$ and $D_3$ may be connected to each other in an opposite condition (not shown).

The construction of the device according to the present invention will be described by referring to another embodiment. FIG. 4 is a circuit diagram of the another embodiment of the voltage-regulating circuit. E is an electronic circuit, F is an electronic circuit, $T_6$ is a NMOS transistor, $T_7$ is a PMOS transistor, $D_4$ is a diode, $C_1$ is a capacitor and, $C_2$ is a capacitor. The electronic circuit C, the diode $D_4$ and the transistor $T_7$ are connected to the emitter of the transistor $T_4$. The diode $D_4$ is connected to the capacitor $C_2$ and the electronic circuit F. The transistor $T_7$ is connected to the capacitor $C_1$ and the electronic circuit E. The transistor $T_5$, the diode $D_2$ and the transistor $T_6$ are connected in series.

Now, the operation will be described. The drain-source voltage $V_{DS5}$ of the transistor $T_5$ is equal to the voltage representing by Eqn. (6), and the sum of the forward voltage of the diode $D_2$ and the voltage $V_{DS5}$ is applied to the gate of the transistor $T_1$. This operation is the same as that in FIG. 3. This circuit is different from the circuit shown in FIG. 3 in that the source of transistor $T_6$ is connected to the earth in order that the transistor $T_6$ serves as an MOS resistor. The electronic circuit C is operated by the application of the emitter voltage $V_E$ of the transistor $T_4$ which is represented by Eqn. (5) and, the electronic circuit F is operated by utilizing the voltage drop across the diode $D_4$. A plurality of diodes can be used instead of the single diode $D_4$, and the capacitor $C_2$ may be provided, if necessary. The electronic circuit E is an electronic circuit which requires a voltage lower than the transistor $T_4$ emitter voltage by the value of the threshold voltage of the transistor $T_7$. The capacitor $C_1$ may be provided according to need. It is also possible that the transistor $T_7$ and the diode $D_4$ are connected in series. In addition, the capacitors $C_1$ and $C_2$ are used for improving the voltage characteristic.

Since the device according to the present invention is constructed as shown in FIG. 2, it is possible to operate a circuit such as an oscillating circuit which requires the constant voltage by using the battery such as a manganic dry cell or a lithium battery in which the terminal voltage changes with use. Moreover, in an integrated circuit consisting of CMOS components, the sum of each threshold voltage of PMOS and NMOS transistors in CMOS is automatically decided in accordance with Eqn. (5), no matter which fabrication process for the IC is used. As a result, it is possible to construct the voltage-regulating circuit according to the present invention which always enables the C-MOS inventer circuit to operate with minimum power consumption.

We claim:

1. In an electronic timepiece having an electronic circuit, a voltage regulating circuit for supplying a regulated voltage to said electronic circuit, said voltage regulating circuit comprising: an N-MOS and a P-MOS transistor pair each having a respective gate, source and drain and connected in series with their respective drains and gates connected together at a common junction; and constant current source means for providing a constant current through said transistor pair for developing the regulated voltage thereacross in response to the constant current flowing therethrough; wherein said constant current source means is comprised of a third MOS transistor connected in series with said transistor pair, and biasing means for biasing said third MOS transistor to provide a constant current through said transistor pair; and wherein said biasing means is comprised of a fourth MOS transistor having a gate, a source and a drain, wherein the source of said fourth MOS transistor is connected to said third MOS transistor opposite said transistor pair, and wherein the gate and drain of said fourth MOS transistor are connected together, a pair of diodes connected in series, wherein a first of said diodes is connected to the gate and drain of said fourth MOS transistor and wherein a connection between said diodes is connected to the gate of said third MOS transistor, and means connecting a second of said diodes to a connection between said transistor pair and said third MOS transistor.

2. In an electronic timepiece according to claim 1 wherein said means connecting is comprised of: a bipolar transistor having a collector connected to the source of said fourth MOS transistor, a base connected to the connection between said transistor pair and said third MOS transistor, and an emitter connected to said second diode.

3. In an electronic timepiece according to claim 2 further comprising: a third diode in series with said transistor pair; and wherein said voltage regulating circuit is an integrated circuit formed on a common integrated circuit chip with said third diode and a base-emitter junction of said bipolar transistor both formed on said ship.

4. In an electronic timepiece having an electronic circuit, a voltage regulating circuit for supplying a regulated voltage to said electronic circuit, said voltage regulating circuit comprising: an N-MOS and a P-MOS transistor pair each having a respective gate, source and drain and connected in series with their respective drains and gates connected together at a common junction; and constant current source means for providing a constant current through said transistor pair for developing the regulated voltage thereacross in response to the constant current flowing therethrough; wherein said constant current source means is comprised of a third MOS transistor connected in series with said transistor pair, and biasing means for biasing said third MOS transistor to provide a constant current through said transistor pair; and wherein said biasing means is comprised of a fourth MOS transistor, a diode and a fifth MOS transistor connected in series in the named order, and wherein said fourth MOS transistor has a gate and a drain connected together and a source connected to the source of said third MOS transistor, and the gate of said third MOS transistor is connected to a connection between said diode and said fifth MOS transistor.

* * * * *